US007815697B2

(12) United States Patent
Krull et al.

(10) Patent No.: US 7,815,697 B2
(45) **Date of Patent: *Oct. 19, 2010**

(54) FUEL OILS COMPOSED OF MIDDLE DISTILLATES AND OILS OF VEGETABLE OR ANIMAL ORIGIN AND HAVING IMPROVED COLD FLOW PROPERTIES

(75) Inventors: Matthias Krull, Harxheim (DE); Bettina Siggelkow, Oberhausen (DE); Martina Hess, Mülheim a. d. Ruhr (DE)

(73) Assignee: Clariant Finance (BVI) Limited, Tortola (VG)

( * ) Notice: Subject to any disclaimer, the term of this patent is extended or adjusted under 35 U.S.C. 154(b) by 1665 days.

This patent is subject to a terminal disclaimer.

(21) Appl. No.: 11/009,885

(22) Filed: Dec. 10, 2004

(65) Prior Publication Data

US 2005/0126072 A1 Jun. 16, 2005

(30) Foreign Application Priority Data

Dec. 11, 2003 (DE) ..... 103 57 880

(51) Int. Cl.
*C10L 1/196* (2006.01)
*C10L 1/234* (2006.01)

(52) U.S. Cl. ..... 44/393; 44/307; 44/308; 44/391; 44/392; 44/394; 44/395; 44/605

(58) Field of Classification Search ..... 44/393, 44/394, 395, 391, 392
See application file for complete search history.

(56) References Cited

U.S. PATENT DOCUMENTS

| | | | | |
|---|---|---|---|---|
| 3,462,249 | A | 8/1969 | Tunkel | |
| 4,211,534 | A | 7/1980 | Feldman | |
| 4,608,411 | A | 8/1986 | Meunier | |
| 4,670,516 | A | 6/1987 | Sackmann | |
| 4,713,088 | A | 12/1987 | Tack et al. | |
| 4,810,260 | A | 3/1989 | Tack et al. | |
| 4,906,682 | A | 3/1990 | Mueller | |
| 4,985,048 | A | 1/1991 | Wirtz et al. | |
| 5,017,299 | A | 5/1991 | Gutierrez | |
| 5,045,088 | A | 9/1991 | Moore | |
| 5,178,641 | A | 1/1993 | Konrad | |
| 5,186,720 | A | 2/1993 | Feustel et al. | |
| 5,200,484 | A | 4/1993 | Reimann | |
| 5,254,652 | A | 10/1993 | Feustel et al. | |
| 5,275,747 | A | 1/1994 | Gutierrez | |
| 5,391,632 | A | 2/1995 | Krull et al. | |
| 5,413,725 | A | 5/1995 | Lal et al. | |
| 5,439,981 | A | 8/1995 | Reimann | |
| 5,441,545 | A | 8/1995 | Lewtas | |
| 5,733,346 | A | 3/1998 | Davies | |
| 5,743,923 | A | 4/1998 | Davies et al. | |
| 5,767,190 | A | 6/1998 | Krull et al. | |
| 5,789,510 | A | 8/1998 | Krull et al. | |
| 5,833,722 | A | 11/1998 | Davies | |
| 5,858,028 | A | 1/1999 | Davies | |
| 6,086,645 | A | 7/2000 | Quigley | |
| 6,090,169 | A * | 7/2000 | Krull et al. | 44/395 |
| 6,162,772 | A | 12/2000 | Dounis | |
| 6,232,277 | B1 | 5/2001 | Ledeore | |
| 6,306,186 | B1 | 10/2001 | Davies | |
| 6,384,170 | B1 | 5/2002 | Krull et al. | |
| 6,409,778 | B1 | 6/2002 | Auschra et al. | |
| 6,458,175 | B1 | 10/2002 | Tack | |
| 6,461,393 | B1 | 10/2002 | Krull | |
| 6,509,424 | B1 | 1/2003 | Krull et al. | |
| 6,565,616 | B1 | 5/2003 | Krull et al. | |
| 6,592,638 | B2 | 7/2003 | Krull | |
| 6,638,325 | B1 | 10/2003 | Brod | |
| 7,500,996 | B2 * | 3/2009 | Krull et al. | 44/393 |
| 2001/0013196 | A1 * | 8/2001 | Krull et al. | 44/388 |
| 2001/0034308 | A1 | 10/2001 | Krull | |
| 2001/0034410 | A1 | 10/2001 | Krull | |
| 2002/0099228 | A1 | 7/2002 | Krull | |
| 2003/0119992 | A1 | 6/2003 | Deneker | |
| 2003/0136046 | A1 | 7/2003 | Jackson | |
| 2003/0163951 | A1 | 9/2003 | Eydoux | |
| 2005/0126071 | A1 * | 6/2005 | Krull et al. | 44/393 |
| 2007/0266620 | A1 * | 11/2007 | Siggelkow et al. | 44/389 |
| 2007/0270318 | A1 * | 11/2007 | Siggelkow et al. | 508/467 |

FOREIGN PATENT DOCUMENTS

| | | |
|---|---|---|
| CA | 2008986 | 8/1990 |
| CA | 2017126 | 11/1990 |
| CA | 2020104 | 12/1990 |
| DE | 3443 475 | 5/1986 |
| DE | 4134347 | 4/1993 |
| EP | 0203 554 | 12/1986 |
| EP | 308176 | 9/1987 |

(Continued)

OTHER PUBLICATIONS

Abstract for DE3443 475, May 28, 1986.

(Continued)

*Primary Examiner*—Ellen M McAvoy
*Assistant Examiner*—Ming Cheung Po
(74) *Attorney, Agent, or Firm*—Tod A. Waldrop

(57) ABSTRACT

The invention provides a fuel oil composition comprising a fuel oil of mineral origin and a fuel oil of vegetable and/or animal origin and as a cold additive, the constituents, at least one copolymer composed of ethylene and 8-21 mol % of at least one acrylic and vinyl ester having a $C_1$-$C_{18}$ alkyl radical and at least one comb polymer containing structural units composed of at least one olefin as monomer 1 which bears at least one $C_8$-$C_{18}$ alkyl radical on the olefinic double bond, and at least one ethylenically unsaturated dicarboxylic acid as monomer 2 which bears at least one $C_8$-$C_{16}$ alkyl radical bonded via an amide and/or imide moiety.

19 Claims, No Drawings

FOREIGN PATENT DOCUMENTS

| | | |
|---|---|---|
| EP | 0254 284 | 1/1988 |
| EP | 0271 738 | 6/1988 |
| EP | 0629 231 | 12/1994 |
| EP | 0543 356 | 2/1997 |
| EP | 0922 716 | 6/1999 |
| JP | 10-237469 | 9/1998 |
| JP | 10-245574 | 9/1998 |
| JP | 11-181453 | 6/1999 |
| JP | 2002-338975 | 11/2002 |
| WO | WO 94/00516 | 6/1993 |
| WO | WO 93/14178 | 7/1993 |
| WO | WO9410267 A1 * | 5/1994 |
| WO | WO 94/17159 | 8/1994 |

OTHER PUBLICATIONS

Abstract for EP 0203 554, Dec. 3, 1986.
Abstract for EP 0254 284, Jan. 27, 1988.
Abstract for EP 0271 738, Jun. 22, 1988.
Abstract for EP 0543 356, Feb. 12, 1997.
Roempp Chemie Lexikon, 9th Ed., (1988-1992) vol. 4, pp. 3351-3354.
German Patent Office—Office Action for DE 1103 57 880.3, Apr. 26, 2006.
English language Abstract for DE 41 34 347. Apr. 22, 1993.

* cited by examiner

FUEL OILS COMPOSED OF MIDDLE DISTILLATES AND OILS OF VEGETABLE OR ANIMAL ORIGIN AND HAVING IMPROVED COLD FLOW PROPERTIES

The present invention relates to mineral fuel oils comprising constituents of vegetable or animal origin and having improved cold flow properties, and also to the use of an additive as a cold flow improver for such fuel oils.

In view of decreasing world crude oil reserves and the discussion about the environmentally damaging consequences of the use of fossil and mineral fuels, there is increasing interest in alternative energy sources based on renewable raw materials (biofuels). These include in particular natural oils and fats of vegetable or animal origin. These are generally triglycerides of fatty acids having from 10 to 24 carbon atoms and a calorific value comparable to conventional fuels, but are at the same time regarded as being less harmful to the environment. Biofuels, i.e. fuels derived from animal or vegetable material, are obtained from renewable sources and, when they are combusted, generate only as much $CO_2$ as had previously been converted to biomass. It has been reported that less carbon dioxide is formed in the course of combustion than by the equivalent amount of crude oil distillate fuel, for example diesel fuel, and that very little sulfur dioxide is formed. In addition, they are biodegradable.

Oils obtained from animal or vegetable material are mainly metabolism products which include triglycerides of monocarboxylic acids, for example acids having from 10 to 25 carbon atoms, and corresponding to the formula

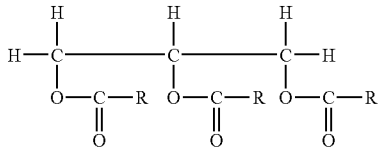

where R is an aliphatic radical which has from 10 to 25 carbon atoms and may be saturated or unsaturated.

In general, such oils contain glycerides from a series of acids whose number and type vary with the source of the oil, and they may additionally contain phosphoglycerides. Such oils can be obtained by processes known from the prior art.

As a consequence of the sometimes unsatisfactory physical properties of the triglycerides, the industry has applied itself to converting the naturally occurring triglycerides to fatty acid esters of low alcohols such as methanol or ethanol.

A hindrance to the use of fatty acid esters of lower monohydric alcohols as a replacement for diesel fuel alone has been found to be its behavior toward engine parts, especially various sealing materials, which lead time and time again to breakdowns of the engines operated using these fuels produced from renewable raw materials. To circumvent these problems, preference is given to using these oils based on renewable raw materials as an additive to conventional middle distillates.

In addition, when triglycerides and also fatty acid esters of lower monohydric alcohols are used as a replacement for diesel fuel, alone or in a mixture with diesel fuel, a hindrance has been found to be the flow behavior at low temperatures. The causes of this are in particular their content of esters of saturated fatty acids and the high uniformity (less than 10 main components) of these oils in comparison to mineral oil middle distillates. For example, rapeseed oil methyl ester (RME) has a Cold Filter Plugging Point (CFPP) of −14° C., soya oil methyl ester a CFPP of −5° C., used fatty acid methyl ester a CFPP of +1° C. and animal fat a CFPP of +9° C. It has hitherto often been impossible using the prior art additives, on the basis of mineral diesel comprising this ester or these esters, to reliably obtain a CFPP value of −20° C. required for use as a winter diesel in Central Europe, or of −22° C. or lower for special applications. This problem is increased when oils are used which comprise relatively large amounts of the likewise readily available oils of sunflowers and soya.

EP-B-0 665 873 discloses a fuel oil composition which includes a biofuel, a fuel oil based on crude oil and an additive which comprises (a) an oil-soluble ethylene copolymer or (b) a comb polymer or (c) a polar nitrogen compound or (d) a compound in which at least one substantially linear alkyl group having from 10 to 30 carbon atoms is bonded to a nonpolymeric organic radical, in order to provide at least one linear chain of atoms which includes the carbon atoms of the alkyl groups and one or more nonterminal oxygen atoms, or (e) one or more of components (a), (b), (c) and (d).

EP-B-0 629 231 discloses a composition which comprises a relatively large proportion of oil which consists substantially of alkyl esters of fatty acids which are derived from vegetable or animal oils or both, mixed with a small proportion of mineral oil cold flow improvers which comprises one or more of the following:

- comb polymer, the copolymer (which may be esterified) of maleic anhydride or
  - fumaric acid and another ethylenically unsaturated monomer, or polymer or copolymer of α-olefin, or fumarate or itaconate polymer or copolymer,
- (II) polyoxyalkylene ester, ester/ether or a mixture thereof,
- (III) ethylene/unsaturated ester copolymer,
- (IV) polar, organic, nitrogen-containing paraffin crystal growth inhibitor,
- (V) hydrocarbon polymer,
- (VI) sulfur-carboxyl compounds and
- (VII) aromatic pour point depressant modified with hydrocarbon radicals, with the proviso that the composition comprises no mixtures of polymeric esters or copolymers of esters of acrylic and/or methacrylic acid which are derived from alcohols having from 1 to 22 carbon atoms.

EP-B-0 543 356 discloses a process for preparing compositions having improved low temperature performance for use as fuels or lubricants, starting from the esters of naturally occurring long-chain fatty acids with monohydric $C_1$-$C_6$-alcohols (FAE), which comprises a) adding PPD additives (pour point depressants) known per se and used for
   improving the low temperature performance of mineral oils in amounts of from 0.0001 to 10% by weight, based on the long-chain fatty acid esters FAE and b) cooling the nonadditized long-chain fatty acid esters FAE to a temperature below the Cold Filter Plugging Point and c) removing the resulting precipitates (FAN).

DE-A-40 40 317 discloses mixtures of fatty acid lower alkyl esters having improved cold stability comprising a) from 58 to 95% by weight of at least one ester within the iodine number range from 50 to 150 and being derived from fatty acids having from 12 to 22 carbon atoms and lower aliphatic alcohols having from 1 to 4 carbon atoms, b) from 4 to 40% by weight of at least one ester of fatty acids having from 6 to 14 carbon atoms and lower aliphatic alcohols having from 1 to 4 carbon atoms and c) from 0.1 to 2% by weight of at least one polymeric ester.

EP-B-0 153 176 discloses the use of polymers based on unsaturated dialkyl $C_4$-$C_8$-dicarboxylates having an average alkyl chain length of from 12 to 14 as cold flow improvers for certain crude oil distillate fuel oils. Mentioned as suitable comonomers are unsaturated esters, in particular vinyl acetate, but also α-olefins.

EP-B-0 153 177 discloses an additive concentrate which comprises a combination of I) a copolymer having at least 25% by weight of an n-alkyl ester of a monoethylenically unsaturated $C_4$-$C_8$ mono- or dicarboxylic acid, the average number of carbon atoms in the n-alkyl radicals being 12-14, and another unsaturated ester or an olefin, with II) another low temperature flow improver for distillate fuel oils.

EP-B-0 746 598 discloses comb polymers as a cold additive in fuel oils which have a cloud point of at most −10° C.

It has hitherto often been impossible using the existing additives to reliably adjust middle distillates comprising fatty acid esters to a CFPP value of −20° C. required for use as a winter diesel in Central Europe or of −22° C. and lower for special applications. An additional problem with the existing additives is lacking sedimentation stability of the additized oils. The paraffins and fatty acid esters precipitating below the cloud point sediment when the oil is stored below the cloud point for a prolonged period and lead to the formation of a phase having poorer cold properties on the bottom of the storage vessel.

It is thus an object of the present invention to provide fuel oils having improved cold properties and comprising middle distillates and fatty acid esters, their CFPP values being at −20° C. and below. Moreover, the sedimentation of precipitated paraffins and fatty acid esters in the course of prolonged storage of the fuel oil should be slowed or prevented in the region of its cloud point or below.

It has now been found that, surprisingly, fuel oils composed of middle distillates and oils of vegetable and/or animal origin, which include an additive comprising ethylene copolymers and certain comb polymers, exhibit excellent cold properties.

The invention thus provides a fuel oil composition F) comprising

F1) a fuel oil of mineral origin and

F2) a fuel oil of vegetable and/or animal origin, and, as a cold additive, the constituents A) at least one copolymer composed of ethylene and 8-21 mol % of at least one acrylic or vinyl ester having a $C_1$-$C_{18}$-alkyl radical and B) at least one comb polymer containing structural units composed of B1) at least one olefin as monomer 1 which bears at least one $C_8$-$C_{18}$ alkyl radical on the olefinic double bond, and B2) at least one ethylenically unsaturated dicarboxylic acid as monomer 2 which bears at least one $C_8$-$C_{16}$ alkyl radical bonded via an amide and/or imide moiety, where the sum Q $$Q = \sum_i w_{1i} \cdot n_{1i} + \sum_j w_{2j} \cdot n_{2j}$$

of the molar averages of the carbon chain length distributions in the alkyl radicals of monomer 1 on the one hand and the alkyl radicals of the amide and/or imide groups of monomer 2 on the other is from 21.0 to 28.0, where $w_1$ is the molar proportion of the individual chain lengths in the alkyl radicals of monomer 1, $w_2$ is the molar proportion of the individual chain lengths in the alkyl radicals of the amide and/or imide groups of monomer 2, $n_1$ are the individual chain lengths in the alkyl radicals of monomer 1, $n_2$ are the individual chain lengths in the alkyl radical of the amide and/or imide groups of monomer 2, i is the serial variable for the individual chain lengths in the alkyl radicals of monomer 1, and j is the serial variable for the individual chain lengths in the alkyl radicals of the amide and/or imide groups of monomer 2.

The invention further provides the use of the above-defined additive comprising constituents A) and B) for improving the cold properties of fuel oil compositions F) comprising fuel oils of mineral (F1) and animal and/or vegetable (F2) origin.

The invention further provides a process for producing fuel oil compositions F) comprising fuel oils of mineral (F1) and animal and/or vegetable (F2) origin, having improved cold flow properties, by adding the above-defined additive comprising constituents A) and B) to the mixture of fuel oils of mineral (F1) and animal and/or vegetable (F2) origin.

Preferred oils of mineral origin are middle distillates. The mixing ratio between the fuel oils of animal and/or vegetable origin (which are also referred to hereinbelow as biofuels) and middle distillates may be between 1:99 and 99:1. Particular preference is given to mixtures which contain from 2 to 50% by volume, in particular from 5 to 40% by volume and especially from 10 to 30% by volume, of biofuels. The inventive additives impart to these mixtures superior cold properties.

In a preferred embodiment of the invention, Q assumes values between 22.0 and 27.0, in particular from 23.0 to 26.0 and for example 23, 24, 24.5, 25 or 26.

Side chain lengths of olefins refers here to the alkyl radical diverging from the polymer backbone, i.e. the chain length of the monomeric olefin minus the two olefinically bonded carbon atoms. In the case of olefins having nonterminal double bonds, for example olefins having vinylidene moiety, the total chain length of the olefin minus the double bond merging into the polymer backbone correspondingly has to be taken into account.

Suitable ethylene copolymers A) are those which contain from 8 to 21 mol % of one or more vinyl and/or (meth)acrylic esters and from 79 to 92 mol % of ethylene. Particular preference is given to ethylene copolymers having from 10 to 18 mol %, and especially from 12 to 16 mol %, of at least one vinyl ester. Suitable vinyl esters are derived from fatty acids having linear or branched alkyl groups having from 1 to 30 carbon atoms. Examples include vinyl acetate, vinyl propionate, vinyl butyrate, vinyl hexanoate, vinyl heptanoate, vinyl octanoate, vinyl laurate and vinyl stearate, and also esters of vinyl alcohol based on branched fatty acids, such as vinyl isobutyrate, vinyl pivalate, vinyl 2-ethylhexanoate, vinyl isononanoate, vinyl neononanoate, vinyl neodecanoate and vinyl neoundecanoate. Likewise suitable as comonomers are esters of acrylic and methacrylic acids having from 1 to 20 carbon atoms in the alkyl radical, such as methyl (meth) acrylate, ethyl (meth)acrylate, propyl (meth)acrylate, n- and isobutyl (meth)acrylate, and hexyl, octyl, 2-ethylhexyl, decyl, dodecyl, tetradecyl, hexadecyl and octadecyl (meth) acrylate, and also mixtures of two, three, four or else more of these comonomers.

Particularly preferred terpolymers of vinyl 2-ethylhexanoate, of vinyl neononanoate or of vinyl neodecanoate contain, apart from ethylene, preferably from 3.5 to 20 mol %, in particular from 8 to 15 mol %, of vinyl acetate, and from 0.1 to 12 mol %, in particular from 0.2 to 5 mol %, of the particular long-chain vinyl ester, the total comonomer content being between 8 and 21 mol %, preferably between 12 and 18 mol %. In addition to ethylene and from 8 to 18 mol % of vinyl esters, further preferred copolymers additionally contain from 0.5 to 10 mol % of olefins such as propene, butene, isobutylene, hexene, 4-methylpentene, octene, diisobutylene and/or norbornene.

The copolymers A preferably have molecular weights which correspond to melt viscosities at 140° C. of from 20 to 10 000 mPas, in particular from 30 to 5000 mPas, and especially from 50 to 1000 mPas. The degrees of branching determined by means of $^1$H NMR spectroscopy are preferably between 1 and 9 $CH_3$/100 $CH_2$ groups, in particular between 2 and 6 $CH_3$/100 $CH_2$ groups, for example from 2.5 to 5 $CH_3$/100 $CH_2$ groups, which do not stem from the comonomers.

The copolymers (A) can be prepared by customary copolymerization processes, for example suspension polymerization, solution polymerization, gas phase polymerization or high pressure bulk polymerization. Preference is given to carrying out the high pressure bulk polymerization at pressures of from 50 to 400 MPa, preferably from 100 to 300 MPa, and temperatures from 100 to 300° C., preferably from 150 to 220° C. In a particularly preferred preparation variant, the polymerization is effected in a multizone reactor in which the temperature difference between the peroxide feeds along the tubular reactor is kept very low, i.e. <50° C., preferably <30° C., in particular <15° C. The temperature maxima in the individual reaction zones preferably differ by less than 30° C., more preferably by less than 20° C. and especially by less than 10° C.

The reaction of the monomers is initiated by free radical-forming initiators (free radical chain initiators). This substance class includes, for example, oxygen, hydroperoxides, peroxides and azo compounds, such as cumene hydroperoxide, t-butyl hydroperoxide, dilauroyl peroxide, dibenzoyl peroxide, bis(2-ethylhexyl) peroxydicarbonate, t-butyl perpivalate, t-butyl permaleate, t-butyl perbenzoate, dicumyl peroxide, t-butyl cumyl peroxide, di(t-butyl) peroxide, 2,2'-azobis(2-methylpropanonitrile), 2,2'-azobis(2-methylbutyronitrile). The initiators are used individually or as a mixture of two or more substances in amounts of from 0.01 to 20% by weight, preferably from 0.05 to 10% by weight, based on the monomer mixture.

The high pressure bulk polymerization is carried out in known high pressure reactors, for example autoclaves or tubular reactors, batchwise or continuously, and tubular reactors have been found to be particularly useful. Solvents such as aliphatic and/or aromatic hydrocarbons or hydrocarbon mixtures, benzene or toluene may be present in the reaction mixture. Preference is given to the substantially solvent-free procedure. In a preferred embodiment of the polymerization, the mixture of the monomers, the initiator and, if used, the moderator, are fed to a tubular reactor via the reactor entrance and also via one or more side branches. Preferred moderators are, for example, hydrogen, saturated and unsaturated hydrocarbons, for example propane or propene, aldehydes, for example propionaldehyde, n-butyraldehyde or isobutyraldehyde, ketones, for example acetone, methyl ethyl ketone, methyl isobutyl ketone, cyclohexanone, and alcohols, for example butanol. The comonomers and also the moderators may be metered into the reactor either together with ethylene or else separately via sidestreams. The monomer streams may have different compositions (EP-A-0 271 738 and EP-A-0 922 716).

Examples of suitable co- or terpolymers include:

ethylene-vinyl acetate copolymers having 10-40% by weight of vinyl acetate and 60-90% by weight of ethylene;

the ethylene-vinyl acetate-hexene terpolymers disclosed by DE-A-34 43 475;

the ethylene-vinyl acetate-diisobutylene terpolymers described in EP-B-0 203 554;

the mixture of an ethylene-vinyl acetate-diisobutylene terpolymer and an ethylene/vinyl acetate copolymer disclosed by EP-B-0 254 284;

the mixtures of an ethylene-vinyl acetate copolymer and an ethylene-vinyl acetate-N-vinylpyrrolidone terpolymer disclosed in EP-B-0 405 270;

the ethylene/vinyl acetate/isobutyl vinyl ether terpolymers described in EP-B-0 463 518;

the ethylene/vinyl acetate/vinyl neononanoate or vinyl neodecanoate terpolymers which, apart from ethylene, contain 10-35% by weight of vinyl acetate and 1-25% by weight of the particular neo compound, disclosed by EP-B-0 493 769;

the terpolymers of ethylene, a first vinyl ester having up to 4 carbon atoms and a second vinyl ester which is derived from a branched carboxylic acid having up to 7 carbon atoms or a branched but nontertiary carboxylic acid having from 8 to 15 carbon atoms, described in EP 0778875;

the terpolymers of ethylene, the vinyl ester of one or more aliphatic $C_2$- to $C_{20}$-monocarboxylic acids and 4-methylpentene-1, described in DE-A-19620 118;

the terpolymers of ethylene, the vinyl ester of one or more aliphatic $C_2$-to $C_{20}$-monocarboxylic acids and bicyclo[2.2.1] hept-2-ene, disclosed in DE-A-196 20 119;

the terpolymers of ethylene and at least one olefinically unsaturated comonomer which contains one or more hydroxyl groups, described in EP-A-0 926 168.

Preference is given to using mixtures of the same or different ethylene copolymers. The polymers on which the mixtures are based more preferably differ in at least one characteristic. For example, they may contain different comonomers, different comonomer contents, molecular weights and/or degrees of branching. The mixing ratio of the different ethylene copolymers is preferably between 20:1 and 1:20, preferably from 10:1 to 1:10, in particular from 5:1 to 1:5.

The copolymers B are derived preferably from copolymers of ethylenically unsaturated dicarboxylic acids and derivatives thereof, such as lower esters and anhydrides. Preference is given to maleic acid, fumaric acid, itaconic acid and esters thereof with lower alcohols having from 1 to 6 carbon atoms and anhydrides thereof, for example maleic anhydride. Particularly suitable comonomers are monoolefins having from 10 to 20, in particular having from 12 to 18, carbon atoms. These are preferably linear and the double bond is preferably terminal, as, for example, in dodecane, tridecene, tetradecene, pentadecene, hexadecene, heptadecene and octadecene. The ratio of dicarboxylic acid or dicarboxylic acid derivative to olefin or olefins in the polymer is preferably in the range from 1:1.5 to 1.5:1, and is especially equimolar.

It is possible for copolymer B also to contain minor amounts of up to 20 mol %, preferably <10 mol %, especially <5 mol %, of further comonomers which are copolymerizable with ethylenically unsaturated dicarboxylic acids and the olefins mentioned, for example shorter- and longer-chain olefins, allyl polyglycol ethers, $C_1$-$C_{30}$-alkyl (meth)acrylates, styrenics or $C_1$-$C_{20}$-alkyl vinyl ethers. Equally, minor amounts of poly(isobutylenes) having molecular weights of up to 5000 g/mol are used, and preference is given to highly reactive variants having a high proportion of terminal vinylidene groups. These further comonomers are not taken into account in the calculation of the factor Q which is critical for the effectiveness.

Alkyl polyglycol ethers correspond to the general formula

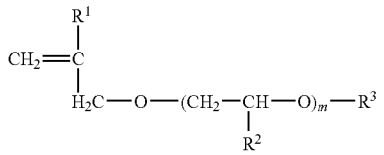

where $R^1$ is hydrogen or methyl, $R^2$ is hydrogen or $C_1$-$C_4$-alkyl, m is a number from 1 to 100, $R^3$ is $C_1$-$C_{24}$-alkyl, $C_5$-$C_{20}$-cycloalkyl, $C_6$-$C_{18}$-aryl or —C(O)—$R^4$, $R^4$ is $C_1$-$C_{40}$-alkyl, $C_5$-$C_{10}$-cycloalkyl or $C_6$-$C_{18}$-aryl.

The inventive copolymers B) are prepared preferably at temperatures between 50 and 220° C., in particular from 100 to 190° C., especially from 130 to 170° C. The preferred preparation process is solvent-free bulk polymerization, but it is also possible to carry out the polymerization in the presence of aprotic solvent such as benzene, toluene, xylene or of higher-boiling aromatic, aliphatic or isoaliphatic solvents or solvent mixtures such as kerosene or Solvent Naphtha. Particular preference is given to polymerizing in a small amount of moderating, aliphatic or isoaliphatic solvents. The proportion of solvent in the polymerization mixture is generally between 10 and 90% by weight, preferably between 35 and 60% by weight. In the solution polymerization, the reaction temperature may be adjusted particularly simply by the boiling point of the solvent or by working under reduced or elevated pressure.

The average molecular mass of the inventive copolymers B is generally between 1200 and 200 000 g/mol, in particular between 2000 and 100 000 g/mol, measured by means of gel permeation chromatography (GPC) against polystyrene standards in THF. Inventive copolymers B have to be oil-soluble in doses relevant in practice, i.e. they have to dissolve without residue at 50° C. in the oil to be additized.

The reaction of the monomers is initiated by free radical-forming initiators (free-radical chain starters). This substance class includes, for example, oxygen, hydroperoxides and peroxides, for example cumene hydroperoxide, t-butyl hydroperoxide, dilauroyl peroxide, dibenzoyl peroxide, bis(2-ethylhexyl) peroxodicarbonate, t-butyl perpivalate, t-butyl permaleinate, t-butyl perbenzoate, dicumyl peroxide, t-butyl cumyl peroxide, di(t-butyl) peroxide, and also azo compounds, for example 2-2'-azobis(2-methylpropanonitrile) or 2,2'-azobis(2-methylbutyronitrile). The initiators are used individually or as a mixture of two or more substances in amounts of from 0.01 to 20% by weight, preferably from 0.05 to 10% by weight, based on the monomer mixture.

The copolymers B may be prepared either by reacting maleic acid, fumaric acid and/or itaconic acid or derivatives thereof with the corresponding amine and subsequently copolymerizing, or by copolymerizing olefin or olefins with at least one unsaturated dicarboxylic acid or derivative thereof, for example itaconic anhydride and/or maleic anhydride and subsequently reacting with amines. Preference is given to carrying out a copolymerization with anhydrides and converting the resulting colymer to an amide and/or an imide after the preparation.

In both cases, the reaction with amines is effected, for example, by reacting with from 0.8 to 2.5 mol of amine per mole of anhydride, preferably with from 1.0 to 2.0 mol of amine per mole of anhydride, at from 50 to 300° C. When approx. 1 mol of amine is used per mole of anhydride, monoamides are formed preferentially at reaction temperatures of from approx. 50 to 100° C. and additionally bear one carboxyl group per amide group. At higher reaction temperatures of from approx. 100 to 250° C., imides are formed preferentially from primary amines with elimination of water. When larger amounts of amine are used, preferably 2 mol of amine per mole of anhydride, amide-ammonium salts are formed at from approx. 50 to 200° C. and diamides at higher temperatures of, for example, 100-300° C., preferably 120-250° C. The water of reaction may be distilled off by means of an inert gas stream or removed by means of azeotropic distillation in the presence of an organic solvent. To this end, preferably 20-80%, in particular 30-70%, especially 35-55% by weight of at least one organic solvent is used. Here, copolymers (diluted to 50% in solvent) having acid numbers of 30-70 mg KOH/g, preferably of 40-60 mg KOH/g, are regarded as monoamides. Corresponding copolymers having acid numbers of less than 40 mg, especially less than 30 mg KOH/g, are regarded as diamides or imides. Particular preference is given to monoamides and imides.

Suitable amines are primary and secondary amines having one or two $C_8$-$C_{16}$-alkyl radicals. They may bear one, two or three amino groups which are bonded via alkylene radicals having two or three carbon atoms. Preference is given to monoamines. In particular, they bear linear alkyl radicals, but may also contain minor amounts, for example up to 30% by weight, preferably up to 20% by weight and especially up to 10% by weight of branched amines (in the 1- or 2-position). Either shorter- or longer-chain amines may be used, but their proportion is preferably below 20 mol % and especially below 10 mol %, for example between 1 and 5 mol %, based on the total amount of the amines used.

Particularly preferred primary amines are octylamine, 2-ethylhexylamine, decylamine, undecylamine, dodecylamine, n-tridecylamine, isotridecylamine, tetradecylamine, pentadecylamine, hexadecylamine and mixtures thereof.

Preferred secondary amines are dioctylamine, dinonylamine, didecylamine, didodecylamine, ditetradecylamine, dihexadecylamine, and also amines having different alkyl chain lengths, for example N-octyl-N-decylamine, N-decyl-N-dodecylamine, N-decyl-N-tetradecylamine, N-decyl-N-hexadecylamine, N-dodecyl-N-tetradecylamine, N-dodecyl-N-hexadecylamine, N-tetradecyl-N-hexadecylamine. Also suitable in accordance with the invention are secondary amines which, in addition to a $C_8$-$C_{16}$-alkyl radical, bear shorter side chains having from 1 to 5 carbon atoms, for example methyl or ethyl groups. In the case of secondary amines, it is the average of the alkyl chain lengths of from $C_8$ to $C_{16}$ that is taken into account as the alkyl chain length n for the calculation of the Q factor. Neither shorter nor longer alkyl radicals, where present, are taken into account in the calculation, since they do not contribute to the effectiveness of the additives.

Particularly preferred copolymers B are monoamides and imides of primary monoamines.

The use of mixtures of different olefins in the polymerization and mixtures of different amines in the amidation or imidation allows the effectiveness to be further adapted to specific fatty acid ester compositions.

In a preferred embodiment, mixtures of the copolymers B according to the invention are used, with the proviso that the average of the Q values of the mixing components in turn assumes values of from 21.0 to 28.0, preferably values from 22.0 to 27.0 and especially values from 23.0 to 26.0.

The mixing ratio of the additives A and B according to the invention is (in parts by weight) from 20:1 to 1:20, preferably from 10:1 to 1:10, in particular from 5:1 to 1:2.

The additives according to the invention are added to oils in amounts of from 0.001 to 5% by weight, preferably from 0.005 to 1% by weight and especially from 0.01 to 0.5% by weight. They may be used as such or else dissolved or dispersed in solvents, for example aliphatic and/or aromatic hydrocarbons or hydrocarbon mixtures, for example toluene, xylene, ethylbenzene, decane, pentadecane, petroleum fractions, kerosene, naphtha, diesel, heating oil, isoparaffins or commercial solvent mixtures such as Solvent Naphtha, ®Shellsol AB, ®Solvesso 150, ®Solvesso 200, ®Exxsol, ®Isopar and ®Shellsol D types. They are preferably dissolved in fuel oil of animal or vegetable origin based on fatty acid alkyl esters. The additives according to the invention preferably comprise 1-80%, especially 10-70%, in particular 25-60%, of solvent.

In a preferred embodiment, the fuel oil F2, which is frequently also referred to as biodiesel or biofuel, is a fatty acid alkyl ester composed of fatty acids having from 12 to 24 carbon atoms and alcohols having from 1 to 4 carbon atoms. Typically, a relatively large portion of the fatty acids contains one, two or three double bonds.

Examples of oils F2 which are derived from animal or vegetable material and can be used in accordance with the invention are rapeseed oil, coriander oil, soya oil, cottonseed oil, sunflower oil, castor oil, olive oil, peanut oil, maize oil, almond oil, palmseed oil, coconut oil, mustardseed oil, bovine tallow, bone oil, fish oils and used cooking oils. Further examples include oils which are derived from wheat, jute, sesame, shea tree nut, arachis oil and linseed oil. The fatty acid alkyl esters also referred to as biodiesel can be derived from these oils by processes disclosed by the prior art. Preference is given to rapeseed oil, which is a mixture of fatty acids partially esterified with glycerol, since it is obtainable in large amounts and is obtainable in a simple manner by extractive pressing of rapeseeds. In addition, preference is given to the likewise widely available oils of sunflowers and soya, and also to their mixtures with rapeseed oil.

Particularly suitable biofuels F2) are lower alkyl esters of fatty acids. These include, for example, commercially available mixtures of the ethyl, propyl, butyl and in particular methyl esters of fatty acids having from 14 to 22 carbon atoms, for example of lauric acid, myristic acid, palmitic acid, palmitolic acid, stearic acid, oleic acid, elaidic acid, petroselic acid, ricinolic acid, elaeostearic acid, linolic acid, linolenic acid, eicosanoic acid, gadoleic acid, docosanoic acid or erucic acid, each of which preferably has an iodine number of from 50 to 150, in particular from 90 to 125. Mixtures having particularly advantageous properties are those which comprise mainly, i.e. comprise at least 50% by weight, of methyl esters of fatty acids having from 16 to 22 carbon atoms, and 1, 2 or 3 double bonds. The preferred lower alkyl esters of fatty acids are the methyl esters of oleic acid, linoleic acid, linolenic acid and erucic acid.

Commercial mixtures of the type mentioned are obtained, for example, by hydrolyzing and esterifying, or by transesterifying, animal and vegetable fats and oils with lower aliphatic alcohols. Equally suitable as starting materials are used cooking oils. To prepare lower alkyl esters of fatty acids, it is advantageous to start from fats and oils having a high iodine number, for example sunflower oil, rapeseed oil, coriander oil, castor oil, soya oil, cottonseed oil, peanut oil or bovine tallow. Preference is given to lower alkyl esters of fatty acids based on a novel type of rapeseed oil, more than 80% by weight of whose fatty acid component is derived from unsaturated fatty acids having 18 carbon atoms.

A biofuel is therefore an oil which is obtained from vegetable or animal material or both or a derivative thereof which can be used as a fuel and in particular as a diesel or heating oil. Although many of the above oils can be used as biofuels, preference is given to vegetable oil derivatives, and particularly preferred biofuels are alkyl ester derivatives of rapeseed oil, cottonseed oil, soya oil, sunflower oil, olive oil or palm oil, and very particular preference is given to rapeseed oil methyl ester, sunflower oil methyl ester and soya oil methyl ester. Particularly preferred as a biofuel or as a component in biofuel are additionally also used fatty esters, for example used fatty acid methyl ester.

Suitable mineral oil components F1 are in particular middle distillates which are obtained by distilling crude oil and boil in the range from 120 to 450° C., for example kerosene, jet fuel, diesel and heating oil. Preference is given to using those middle distillates which contain 0.05% by weight of sulfur and less, more preferably less than 350 ppm of sulfur, in particular less than 200 ppm of sulfur and in special cases less than 50 ppm of sulfur, for example less than 10 ppm of sulfur. These are generally those middle distillates which have been subjected to refining under hydrogenating conditions, and therefore contain only small proportions of polyaromatic and polar compounds. They are preferably those middle distillates which have 95% distillation points below 370° C., in particular 350° C. and in special cases below 330° C. Synthetic fuels, as obtainable, for example, by the Fischer-Tropsch process, are also suitable as middle distillates.

The additive can be added to the oil to be additized in accordance with prior art processes. When more than one additive component or coadditive component is to be used, such components can be introduced into the oil together or separately in any desired combination and sequence.

The inventive additives allow the CFPP value of mixtures of biodiesel and mineral oils to be improved much more efficiently than using the known prior art additives. The inventive additives are particularly advantageous in oil mixtures whose mineral oil component F1) has a boiling range between the 20% and the 90% distillation point of less than 120° C., in particular of less than 110° C. and especially of less than 100° C. In addition, they are particularly advantageous in oil mixtures whose mineral oil component F1) has a cloud point of below −4° C., in particular from −6° C. to −20° C., for example from −7° C. to −9° C., as required for use in winter in particular. Equally, the pour point of the inventive mixtures is reduced by the addition of the inventive additives. The inventive additives are particularly advantageous in oil mixtures F which contain more than 2% by volume of biofuel F2, preferably more than 5% by volume of biofuel F2 and especially more than 10% by volume of biofuel F2, for example from 15 to 35% by volume of biofuel F2. The inventive additives are additionally particularly advantageous in problematic oils whose biofuel component F2 contains a high proportion of esters of saturated fatty acids of more than 4%, in particular of more than 5% and especially having from 7 to 25%, for example having from 8 to 20%, as present, for example, in oils from sunflowers and soya. Such biofuels preferably have a cloud point of above −5° C. and especially above −3° C. Oil mixtures F) in which the inventive additives exhibit particularly advantageous action preferably have cloud points of above −9° C. and especially of above −6° C. It is thus also possible using the inventive additives to adjust oil mixtures comprising rapeseed oil methyl ester and sunflower and/or soya oil fatty acid methyl ester to CFPP values of −22° C. and below.

To prepare additive packages for specific solutions to problems, the inventive additives can also be used together with one or more oil-soluble coadditives which alone improve the cold flow properties of crude oils, lubricant oils or fuel oils. Examples of such coadditives are polar compounds which differ from the inventive polymers B and bring about paraffin dispersion (paraffin dispersants), alkylphenol condensates, esters and ethers of polyoxyalkylene compounds, olefin copolymers, and also oil-soluble amphiphiles.

For instance, the inventive additives may be used in a mixture with paraffin dispersants to further reduce the sedimentation under cold conditions of precipitated paraffins and fatty acid esters. Paraffin dispersants reduce the size of the paraffin and fatty acid ester crystals and have the effect that the paraffin particles do not separate but remain dispersed colloidally with a distinctly reduced tendency to sedimentation. Useful paraffin dispersants have been found to be both low molecular weight and polymeric oil-soluble compounds having ionic or polar groups, for example amine salts and/or amides. Particularly preferred paraffin dispersants comprise reaction products of fatty amines having alkyl radicals having from 18 to 24 carbon atoms, in particular secondary fatty amines, for example ditallow fat amine, distearylamine and dibehenylamine with carboxylic acids and derivatives thereof. Particularly useful paraffin dispersants have been found to be those obtained by reacting aliphatic or aromatic amines, preferably long-chain aliphatic amines, with aliphatic or aromatic mono-, di-, tri- or tetracarboxylic acids or their anhydrides (cf. U.S. Pat. No. 4,211,534). Equally suitable paraffin dispersants are amides and ammonium salts of aminoalkylenepolycarboxylic acids such as nitrilotriacetic acid or ethylenediaminetetraacetic acid with secondary amines (cf.

EP 0 398 101). Other paraffin dispersants are copolymers of maleic anhydride and α,β-unsaturated compounds which may optionally be reacted with primary monoalkylamines and/or aliphatic alcohols (cf. EP 0 154 177) and the reaction products of alkenyl-spiro-bislactones with amines (cf. EP 0 413 279 B1) and, according to EP 0 606 055 A2, reaction products of terpolymers based on α,β-unsaturated dicarboxylic anhydrides, α,β-unsaturated compounds and polyoxyalkylene ethers of lower unsaturated alcohols.

Alkylphenol-aldehyde resins are described, for example, in Römpp Chemie Lexikon, 9th edition, Thieme Verlag 1988-92, volume 4, p. 3351ff. In the alkylphenol-aldehyde resins which can be used in the inventive additives, the alkyl radicals of the o- or p-alkylphenol may be the same or different and have 1-50, preferably 1-20, in particular 4-12, carbon atoms; they are preferably n-, iso- and tert-butyl, n- and isopentyl, n- and isohexyl, n- and isooctyl, n- and isononyl, n- and isodecyl, n- and isododecyl and octadecyl. The aliphatic aldehyde in the alkylphenol-aldehyde resin preferably has 1-4 carbon atoms. Particularly preferred aldehydes are formaldehyde, acetaldehyde and butyraldehyde, in particular formaldehyde. The molecular weight of the alkylphenol-aldehyde resins is 400-10 000 g/mol, preferably 400-5000 g/mol. A prerequisite is that the resins are oil-soluble.

In a preferred embodiment of the invention, these alkylphenol-formaldehyde resins are those which contain oligo- or polymers having a repeating structural unit of the formula

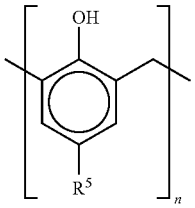

where $R^5$ is $C_1$-$C_{50}$-alkyl or -alkenyl and n is a number from 2 to 100. $R^5$ is preferably $C_4$-$C_{20}$-alkyl or -alkenyl and in particular $C_6$-$C_{16}$-alkyl or -alkenyl. n is preferably a number from 4 to 50 and especially a number from 5 to 25.

Further suitable flow improvers are polyoxyalkylene compounds, for example esters, ethers and ether/esters which bear at least one alkyl radical having from 12 to 30 carbon atoms. When the alkyl groups stem from an acid, the rest stems from a polyhydric alcohol; when the alkyl radicals come from a fatty alcohol, the rest of the compound stems from a polyacid.

Suitable polyols are polyethylene glycols, polypropylene glycols, polybutylene glycols and their copolymers having a molecular weight of from approx. 100 to approx. 5000, preferably from 200 to 2000. Also suitable are alkoxylates of polyols, for example glycerol, trimethylolpropane, pentaerythritol, neopentyl glycol, and also the oligomers obtainable therefrom by condensation and having from 2 to 10 monomer units, for example polyglycerol. Preferred alkoxylates are those having from 1 to 100 mol, in particular from 5 to 50 mol, of ethylene oxide, propylene oxide and/or butylene oxide per mole of polyol. Particular preference is given to esters.

Fatty acids having from 12 to 26 carbon atoms are preferably used for reaction with the polyols to form the ester additives, although preference is given to using $C_{18}$ to $C_{24}$ fatty acids, especially stearic acid and behenic acid. The esters can also be prepared by esterification of polyoxyalkylated alcohols. Preference is given to fully esterified polyoxyalkylated polyols having molecular weights of from 150 to 2000, preferably from 200 to 1500. PEG-600 dibehenate and glycerol-ethylene glycol tribehenate are particularly suitable.

Olefin polymers suitable as a constituent of the inventive additive may be derived directly from monoethylenically unsaturated monomers or be prepared indirectly by hydrogenating polymers which are derived from polyunsaturated monomers such as isoprene or butadiene. In addition to ethylene, preferred copolymers contain structural units which are derived from α-olefins having from 3 to 24 carbon atoms and molecular weights of up to 120 000. Preferred α-olefins are propylene, butene, isobutene, n-hexene, isohexene, n-octene, isooctene, n-decene, isodecene. The comonomer content of olefins is preferably between 15 and 50 mol %, more preferably between 20 and 35 mol % and especially between 30 and 45 mol %. These copolymers may also contain small amounts, for example up to 10 mol %, of further comonomers, for example nonterminal olefins or nonconjugated olefins. Preference is given to ethylene-propylene copolymers. The olefin copolymers may be prepared by known methods, for example by means of Ziegler or metallocene catalysts.

Further suitable olefin copolymers are block copolymers which contain blocks of olefinically unsaturated aromatic monomers A and blocks of hydrogenated polyolefins B. Particularly suitable block copolymers have the structure $(AB)_nA$ and $(AB)_m$ where n is a number between 1 and 10 and m is a number between 2 and 10.

The mixing ratio (in parts by weight) of the inventive additives with paraffin dispersants, comb polymers, alkylphenol condensates, polyoxyalkylene derivatives and olefin copolymers respectively is in each case from 1:10 to 20:1, preferably from 1:1 to 10:1, for example from 1:1 to 4:1.

The additives may be used alone or else together with other additives, for example with other pour point depressants or dewaxing assistants, with antioxidants, cetane number improvers, dehazers, deemulsifiers, detergents, dispersants, antifoams, dyes, corrosion inhibitors, conductivity improvers, sludge inhibitors, odorants and/or additives for lowering the cloud point.

EXAMPLES

Characterization of the test oils:

The CFPP value is determined to EN 116 and the cloud point to ISO 3015. Both properties are determined in ° C.

TABLE 1

Characterization of the biofuels used (F2)

| Oil No. | | CP | CFPP |
|---|---|---|---|
| E 1 | Rapeseed oil methyl ester | −2.3 | −14° C. |
| E 2 | 80% rapeseed oil methyl ester + 20% sunflower oil methyl ester | −1.6 | −8° C. |
| E 3 | 90% rapeseed oil methyl ester + 10% soya oil methyl ester | −2.0 | −8° C. |

TABLE 2

Carbon chain distribution of the fatty acid methyl esters used to prepare the test oils (main constituents; area % by GC):

| | $C_{16}$ | $C_{16}'$ | $C_{18}$ | $C_{18}'$ | $C_{18}''$ | $C_{18}'''$ | $C_{20}$ | $C_{20}'$ | $C_{22}$ | Σ saturated |
|---|---|---|---|---|---|---|---|---|---|---|
| RME | 4.5 | 0.5 | 1.7 | 61.6 | 18.4 | 8.7 | 0.7 | 1.5 | 0.4 | 7.3 |
| SFME | 6.0 | 0.1 | 3.8 | 28.7 | 58.7 | 0.1 | 0.3 | 0.3 | 0.7 | 10.8 |
| SoyaME | 10.4 | 0.1 | 4.1 | 24.8 | 51.3 | 6.9 | 0.5 | 0.4 | 0.4 | 15.4 |

RME = Rapeseed oil methyl ester;
SFME = Sunflower oil methyl ester;
SoyaME = Soya oil methyl ester

TABLE 3

Characterization of the mineral oils used (F1)

| | D 1 | D 2 | D 3 |
|---|---|---|---|
| Initial boiling point | 193° C. | 181° C. | 200° C. |
| 20% distillation | 230° C. | 235° C. | 247° C. |
| 90% distillation | 332° C. | 344° C. | 339° C. |
| 95% distillation | 348° C. | 361° C. | 358° C. |
| (90 − 20)% distillation | 102° C. | 109° C. | 92° C. |
| Cloud point | −6.0° C. | −8.2° C. | −4.7° C. |

TABLE 3-continued

Characterization of the mineral oils used (F1)

| | D 1 | D 2 | D 3 |
|---|---|---|---|
| CFPP | −8° C. | −12° C. | −9° C. |
| Sulfur content | 20 ppm | 32 ppm | 9 ppm |

The following additives were used:

Ethylene Copolymers A

The ethylene copolymers used are commercial products having the characteristics specified in Table 4. The products were used as 65% dilutions in kerosene.

TABLE 4

Characterization of the ethylene copolymers used (A)

| Example | Comonomer(s) | V140 | $CH_3$/100 $CH_2$ |
|---|---|---|---|
| A1 | 13.6 mol % of vinyl acetate | 130 mPas | 3.7 |
| A2 | 13.7 mol % of vinyl acetate and 1.4 mol % of vinyl neodecanoate | 105 mPas | 5.3 |
| A3 | i) 14.0 mol % of vinyl acetate and 1.6 mol % of vinyl neodecanoate and | 97 mPas | 4.7 |
| | ii) 12.9 mol % of vinyl acetate in a i):ii) ratio of 6:1 | 145 mPas | 5.4 |

Comb Polymers B

The polymerization of maleic anhydride (MA) with α-olefins is effected in a relatively high-boiling aromatic hydrocarbon mixture at 160° C. in the presence of a mixture of equal parts of tert-butyl peroxybenzoate and tert-butyl peroxy-2-ethylhexanaote as a free-radical chain starter. Table 5 lists various copolymers by way of example and the molar proportions of the monomers used to prepare them, and also chain length (R) and molar amount (based on MA) of the amine used for derivatization and the factor Q calculated therefrom. The amines used, unless stated otherwise, are monoalkylamines.

The reactions with amines are effected in the presence of Solvent Naphtha (from 40 to 50% by weight) at from 50 to 100° C. to give the monoamide or to give the amide-ammonium salt and at from 160 to 200° C. with azeotropic separation of water of reaction to give the imide or diamide. The degree of amidation is inversely proportional to the acid number.

TABLE 5

Characterization of the comb polymers used (B)

| Example | Comonomers | Amine R | Amine Mol | Amine Q | Acid No. [mg KOH/g] |
|---|---|---|---|---|---|
| B1 | MA-co-$C_{14/16}$-α-olefin (1:0.5:0.5) | $C_8$ | 1 | 21 | 52 |
| B2 | MA-co-$C_{14/16}$-α-olefin (1:0.5:0.5) | $C_{10}$ | 1 | 23.0 | 60 |
| B3 | MA-co-$C_{14/16}$-α-olefin (1:0.5:0.5) | $C_{12}$ | 1 | 25.0 | 58 |
| B4 | MA-co-$C_{14/16}$-α-olefin (1:0.5:0.5) | $C_{14}$ | 1 | 27.0 | 56 |
| B5 (C) | MA-co-$C_{14/16}$-α-olefin (1:0.5:0.5) | $C_{16}$ | 1 | 29.0 | 55 |
| B6 (C) | MA-co-$C_{10}$-α-olefin (1:1) | $C_{12}$ | 1 | 20.0 | 57 |
| B7 | MA-co-$C_{16}$-α-olefin (1:1) | $C_{12}$ | 1 | 26.0 | 56 |
| B8 | MA-co-$C_{14}$-α-olefin (1:1) | $C_{14}$ | 1 | 26.0 | 58 |
| B9 | MA-co-$C_{10}$-α-olefin (1:1) | $C_{16}$<br>$C_{18}$ | 0.5<br>0.5 | 25.0 | 59 |
| B10 | MA-co-$C_{14/16}$-α-olefin-co-allyl-methyl polyglycol (1:0.45:0.45:0.1) | $C_{12}$ | 1 | 25.0 | 56 |
| B11 | MA-co-$C_{14/16}$-α-olefin (1:0.5:0.5) | $C_{12}$ | 2 | 25.0 | 0.32 |
| B12 | MA-co-$C_{14/16}$-α-olefin (1:0.5:0.5) | $C_{12}$ | 1 | 25.0 | 1.5 |
| B13 | MA-co-$C_{14/16}$-α-olefin (1:0.5:0.5) | di-$C_{12}$ | 1 | 25.0 | 50 |
| B14 (C) | Fumarate-vinyl acetate (1:1) | $C_{14}$ | 2 | n.a. | 0.4 |

n.a. = not applicable
(C) = comparative example

Further Flow Improvers

The further flow improvers used C are commercial products having the characteristics specified in Table 6. The products were used as 50% dilutions in Solvent Naphtha.

TABLE 6

Characterization of the further flow improvers used

| | |
|---|---|
| C3 | Reaction product of a copolymer composed of $C_{14}/C_{16}$ olefin and maleic anhydride with 2 equivalents of secondary tallow fat amine per maleic anhydride unit |
| C4 | Reaction product of phthalic anhydride with 2 equivalents of di(hydrogenated tallow fat amine) to give an amide ammonium salt |
| C5 | Nonylphenol resin prepared by condensation of a mixture of dodecylphenol with formaldehyde, Mw 2000 g/mol |

TABLE 6-continued

Characterization of the further flow improvers used

| | |
|---|---|
| C6 | Mixture of 2 parts of C3 and 1 part of C5 |
| C7 | Mixture of equal parts of C4 and C5 |

Effectiveness of the Additives

The CFPP value (to EN 116, in ° C.) of different biofuels as per the above table was determined after addition of 1200 ppm, 1500 ppm and 2000 ppm of additive mixture. Percentages are based on parts by weight in the particular mixtures. The results reproduced in Tables 5 to 7 show that the comb polymers having the inventive factor Q achieve outstanding CFPP reductions even at low dosages and offer additional potential at higher dosages.

TABLE 7

CFPP testing in a mixture of 75% by volume of test oil D1 and 25% by volume of test oil E1 (CP = −5.2° C.; CFPP = −9° C.)

| Ex. | Flow improver | Comb polymer/ coadditive | CFPP after addition of flow improver 50 ppm | 100 ppm | 150 ppm | 200 ppm |
|---|---|---|---|---|---|---|
| 1 | A2 | 150 ppm B1 | −11 | −18 | −19 | −22 |
| 2 | A2 | 150 ppm B2 | −18 | −19 | −20 | −21 |
| 3 | A2 | 150 ppm B3 | −21 | −21 | −21 | −22 |
| 4 | A2 | 150 ppm B4 | −11 | −15 | −18 | −20 |
| 5 (C) | A2 | 150 ppm B5 | −9 | −9 | −11 | −17 |
| 6 (C) | A2 | 150 ppm B6 | −10 | −13 | −13 | −15 |
| 7 | A1 | 150 ppm B9 | −19 | −20 | −22 | −23 |
| 8 | A1 | 100 ppm B10 | −20 | −20 | −21 | −23 |
| 9 | A1 | 100 ppm B11 | −19 | −20 | −20 | −22 |
| 10 | A1 | 100 ppm B12 | −21 | −22 | −22 | −23 |
| 11 | A2 | 150 ppm B13 | −18 | −19 | −19 | −22 |
| 12 | A2 | 75 ppm B3<br>75 ppm A4 | −18 | −20 | −22 | −25 |
| 13 (C) | A2 | 150 ppm B14 | −10 | −11 | −15 | −20 |
| 14 (C) | A2 | — | −11 | −16 | −17 | −19 |

TABLE 8

CFPP testing in a mixture of 70% by volume of test oil D2 and 30% by volume of test oil E3 (CP = −5.8° C.; CFPP = −12° C.)

| Ex. | Ethylene copolymer | Comb polymer | Coadditive | CFPP 100 ppm | 150 ppm | 200 ppm | 300 ppm |
|---|---|---|---|---|---|---|---|
| 15 | 80% A3 | 20% B1 | 150 ppm C6 | −18 | −20 | −22 | −22 |
| 16 | 80% A3 | 20% B2 | 150 ppm C6 | −20 | −21 | −21 | −24 |
| 17 | 80% A3 | 20% B3 | 150 ppm C6 | −20 | −22 | −23 | −27 |
| 18 | 80% A3 | 20% B4 | 150 ppm C6 | −20 | −22 | −22 | −23 |
| 19 | 75% A1 | 25% B7 | 150 ppm C7 | −19 | −21 | −22 | −24 |
| 20 | 85% A1 | 15% B8 | 150 ppm C7 | −19 | −22 | −24 | −25 |
| 21 | 80% A1 | 20% B11 | 150 ppm C6 | −20 | −22 | −23 | −25 |
| 22 | 80% A1 | 20% B12 | 150 ppm C6 | −20 | −23 | −24 | −26 |
| 23 (C) | 80% A3 | 20% B6 | 150 ppm C6 | −18 | −19 | −20 | −20 |
| 24 (C) | 80% A3 | 20% B5 | 150 ppm C6 | −10 | −14 | −17 | −18 |
| 25 (C) | 80% A1 | 20% B14 | 150 ppm C7 | −15 | −16 | −18 | −22 |
| 26 (C) | 100% A1 | — | 150 ppm C6 | −18 | −19 | −20 | −22 |

In this test series, in each case a constant amount of coadditive and the specified amount of a mixture of ethylene copolymer and comb polymer were added to the oil.

TABLE 9

CFPP testing in a mixture of 80% by volume of test oil D3 and 20% by volume of test oil E2 (CP = −3.3° C.; CFPP = −10° C.)

| Ex. | Ethylene copolymer | Comb polymer | CFPP 100 ppm | 200 ppm | 250 ppm | 300 ppm |
|---|---|---|---|---|---|---|
| 27 | 80% A3 | 20% B1 | −16 | −19 | −24 | −26 |
| 28 | 80% A3 | 20% B2 | −20 | −23 | −25 | −27 |
| 29 | 80% A3 | 20% B3 | −21 | −22 | −24 | −28 |
| 30 | 80% A1 | 20% B12 | −21 | −23 | −25 | −29 |
| 31 | 80% A3 | 20% B4 | −19 | −21 | −23 | −25 |
| 32 (C) | 85% A3 | 20% B6 | −15 | −18 | −22 | −23 |
| 33 (C) | 80% A3 | 20% B5 | −10 | −15 | −17 | −19 |
| 34 (C) | 80% A1 | 20% B14 | −15 | −17 | −19 | −21 |
| 35 (C) | 100% A1 | — | −11 | −20 | −22 | −22 |

What is claimed is:

1. A fuel oil composition F) comprising

F1) a fuel oil of mineral origin and

F2) a fuel oil of vegetable or animal origin, and a cold additive comprising the constituents A) at least one copolymer composed of ethylene and 8-21 mol % of a comonomer of at least one acrylic or vinyl ester having a $C_1$-$C_{18}$-alkyl radical and B) at least one comb polymer containing structural units composed of B1) at least one olefin as monomer 1 which bears at least one $C_8$-$C_{18}$ alkyl radical on the olefinic double bond, and B2) at least one ethylenically unsaturated dicarboxylic acid as monomer 2 which bears at least one $C_8$-$C_{16}$ alkyl radical bonded via an amide or imide moiety, where the sum Q $$Q = \sum_i w_{1i} \cdot n_{1i} + \sum_j w_{2j} \cdot n_{2j}$$

of molar averages of the carbon chain length distributions in the alkyl radical of monomer 1 on the one hand and the alkyl radical of the amide or imide moiety of monomer 2 on the other is from 21.0 to 28.0, where $w_1$ is a molar proportion of the individual chain lengths in the alkyl radicals of monomer 1, $w_2$ is a molar proportion of the individual chain lengths in the alkyl radical of the amide or imide moiety of monomer 2, $n_1$ are individual chain lengths in the alkyl radical of monomer 1, $n_2$ are individual chain lengths in the alkyl radical of the amide or imide moiety of monomer 2, i is a serial variable for the individual chain lengths in the alkyl radical of monomer 1, and j is a serial variable for the individual chain lengths in the alkyl radical of the amide and/or imide moiety of monomer 2.

2. The fuel oil composition as claimed in claim 1, wherein Q is from 22.0 to 27.0.

3. The fuel oil composition of claim 1, wherein the comonomer constituent A, comprises from 3.5 to 20 mol % of vinyl acetate and from 0.1 to 12 mol % of a vinyl ester selected from the group consisting of neononanoate, vinyl neodecanoate, vinyl 2-ethyihexanoate, and mixtures thereof, wherein constituent A has a total comonomer content between 8 and 21 mol %.

4. The fuel oil composition of claim 1, wherein the comonomer of constituent A from 8 to 18 mol % of vinyl esters, and further comprises from 0.5 to 10 mol % of olefins selected from the group consisting of propene, butene, isobutylene, hexene, 4-methylpentene, octene, diisobutylene, norbornene, and mixtures thereof.

5. The fuel oil composition of claim 1, wherein the copolymers which make up constituent A have melt viscosities between 20 and 10 000 mPas.

6. The fuel oil composition of claim 1, wherein the copolymer which make up constituent A have a degree of branching between 1 and 9 $CH_3$/100 $CH_2$ groups which do not stem from the comonomer.

7. The fuel oil composition of claim 1, wherein constituent B comprises monomers which are derived from amides or imides of an acid selected from the group consisting of maleic acid, fumaric acid, itaconic acid, and mixtures thereof.

8. The fuel oil composition of claim 1, wherein the amide or imide moiety of constituent B is derived from primary amines.

9. The fuel oil of claim 1, wherein the amide or imide moiety of constituent B is derived from amines having linear alkyl radicals.

10. The fuel oil composition of claim 1, wherein the amide or imide moiety of constituent B are derived from monoamines.

11. The fuel oil composition of claim 1, wherein the average molecular mass of the constituent B is between 1200 and 200 000 g/mol.

12. The fuel oil composition of claim 1, wherein constituent B comprises monomers which are derived from α-olefins.

13. The fuel oil composition of claim 1, wherein a mixing ratio A:B is between 10:1 and 1:10.

14. The fuel oil composition of claim 1, further comprising polar nitrogen-containing paraffin dispersants.

15. A fuel oil composition of claim 1, wherein F2 is greater than 2% by volume of the fuel composition.

16. The fuel oil composition of claim 1, wherein the fuel oil of animal or vegetable origin comprises one or more esters composed of monocarboxylic acid having from 14 to 24 carbon atoms and alcohol having from 1 to 4 carbon atoms.

17. The fuel oil composition of claim 16, wherein the alcohol is methanol or ethanol.

18. A fuel oil composition of claim 1, wherein the fuel oil of animal or vegetable origin contains more than 4% by weight of esters of saturated fatty acids.

19. A process for improving the cold flow properties of mixtures of mineral fuel oils and fuel oils of animal or vegetable origin, said process comprising adding to said mixtures a cold additive comprising:

the constituents

A) at least one copolymer composed of ethylene and 8-21 mol % of a comonomer of at least one acrylic or vinyl ester having a $C_1$-$C_{18}$-alkyl radical and B) at least one comb polymer containing structural units composed of B1) at least one olefin as monomer 1 which bears at least one $C_8$-$C_{18}$ alkyl radical on the olefinic double bond, and B2) at least one ethylenically unsaturated dicarboxylic acid as monomer 2 which bears at least one $C_8$-$C_{16}$ alkyl radical bonded via an amide or imide moiety, where the sum Q $$Q = \sum_i w_{1i} \cdot n_{1i} + \sum_j w_{2j} \cdot n_{2j}$$

of molar averages of the carbon chain length distributions in the alkyl radical of monomer 1 on the one hand and the alkyl radical of the amide or imide moiety of monomer 2 on the other is from 21.0 to 28.0, where $w_1$ is a molar proportion of the individual chain lengths in the alkyl radicals of monomer 1, $w_2$ is a molar proportion of the individual chain lengths in the alkyl radical of the amide or imide moiety of monomer 2, $n_1$ are individual chain lengths in the alkyl radical of monomer 1, $n_2$ are individual chain lengths in the alkyl radical of the amide or imide moiety of monomer 2, i is a serial variable for the individual chain lengths in the alkyl radical of monomer 1, and j is a serial variable for the individual chain lengths in the alkyl radical of the amide and/or imide moiety of monomer 2.

* * * * *